US008550319B2

(12) United States Patent
Raghuprasad

(10) Patent No.: US 8,550,319 B2
(45) Date of Patent: Oct. 8, 2013

(54) MULTIPLE TABLET CUTTER

(76) Inventor: Puthalath Koroth Raghuprasad, Odessa, TX (US)

( * ) Notice: Subject to any disclaimer, the term of this patent is extended or adjusted under 35 U.S.C. 154(b) by 386 days.

(21) Appl. No.: 12/774,068

(22) Filed: May 5, 2010

(65) Prior Publication Data

US 2011/0271530 A1 Nov. 10, 2011

(51) Int. Cl.
*B26F 3/00* (2006.01)

(52) U.S. Cl.
USPC ..... 225/93; 225/97; 225/103; 225/105

(58) Field of Classification Search
USPC ..... 225/93, 97, 103, 104, 106, 105; 30/296.5, 296.1, 275.5, 275.4, 299, 30/305, 124; 241/169.2, 169
See application file for complete search history.

(56) References Cited

U.S. PATENT DOCUMENTS

| | | | | |
|---|---|---|---|---|
| 2,655,259 | A | 10/1953 | Francis | |
| 4,055,892 | A * | 11/1977 | Del Vecchio | 30/303 |
| 4,173,826 | A | 11/1979 | Heinrich et al. | |
| 4,199,863 | A | 4/1980 | Deckert | |
| 4,422,553 | A | 12/1983 | Hoeks | |
| 4,473,192 | A | 9/1984 | Urban | |
| 4,694,996 | A * | 9/1987 | Siegel | 241/100 |
| 4,697,344 | A * | 10/1987 | Leopoldi | 30/124 |
| 5,118,021 | A | 6/1992 | Fiocchi | |
| 5,579,582 | A * | 12/1996 | Carlson | 30/299 |
| 6,474,525 | B1 | 11/2002 | Reitano | |
| D467,664 | S | 12/2002 | Chue | |
| 6,557,945 | B1 * | 5/2003 | Eric | 30/124 |
| 6,601,746 | B2 | 8/2003 | Buckley | |
| 6,644,528 | B1 | 11/2003 | Reitano | |
| 6,968,987 | B1 | 11/2005 | Reitano | |
| 7,000,815 | B1 * | 2/2006 | Tipton et al. | 225/103 |
| 7,252,254 | B1 * | 8/2007 | Engel et al. | 241/168 |
| 7,275,671 | B1 * | 10/2007 | Reitano | 225/93 |
| 7,364,102 | B2 * | 4/2008 | Engel et al. | 241/169 |
| 7,503,471 | B2 | 3/2009 | Iwasaki | |
| 2003/0084574 | A1 | 5/2003 | Eric | |
| 2005/0193885 | A1 | 9/2005 | Lykam | |
| 2006/0138190 | A1 | 6/2006 | Williams | |
| 2009/0031872 | A1 | 2/2009 | Lykam | |

FOREIGN PATENT DOCUMENTS

| | | |
|---|---|---|
| CN | 201023244 | 2/2008 |
| JP | 2002325824 | 11/2002 |
| WO | 9219207 | 11/1992 |

* cited by examiner

*Primary Examiner* — Omar Flores Sanchez
(74) *Attorney, Agent, or Firm* — David L King

(57) ABSTRACT

A multi-tablet cutting device has a removable tablet holding tray, a housing structure and a plurality of vertically movable cutting blades. The removable tablet holding tray has a plurality of tablet nests. Each nest has two or more levels of beds sized to hold tablets of different sizes or shapes. The housing structure has at least one opening to receive the removable tablet holding tray. The plurality of vertically movable cutting blades is mounted on a support structure on the inside of the housing above the tablet holding tray above a location where the tablet holding tray is stored. The plurality of cutting blades is aligned above the tablet nests and upon a downwardly directed vertical movement the plurality of cutting blades passes through first slots in the nests aligned with the cutting blades to cut the tablets held in the nests into halves.

17 Claims, 11 Drawing Sheets

MULTIPLE TABLET CUTTER

TECHNICAL FIELD

This invention relates an improved pill or tablet cutter device and more particularly to a tablet cutter for simultaneously cutting a plurality of pills. More specifically it relates to a tablet cutter which can simultaneously cut a plurality of tablets of different sizes.

BACKGROUND OF THE INVENTION

Medicines can be delivered in the shape of a pill or tablet. These pills or tablets provide a dosage of medicine that can be administered to the patient. Oftentimes the amount contained in the tablet is more than is required for a patient and in order to get the proper dosage it is convenient to split the tablet in half or even quarters. Oftentimes the individual patient is requested to split his own medicine dosage of tablets to the proper dosage. To achieve this, a variety of pill cutters have been provided, almost all are designed to cut a single pill of a particular size. Some of these are described in U.S. Pat. Nos. 6,474,525; 7,275,671; 7,000,815; 5,118,021 and U.S. design Pat. No. 467,664. Each of these pill cutter or pill splitter devices has a limitation as it can handle only one pill at a time. In U.S. design Pat. No. 305,960 a two pill compartment is provided on a hinged surface.

When a patient needs to cut a plurality of pills or more than one pill, very few devices are available. In U.S. Pat. No. 4,697,344 a multi-pill cutter is described which accomplishes the objective of allowing a number of pills to be cut simultaneously. In order to achieve this, a resilient pad has been put in a container; the pad has a plurality of holes in it to accept pills of a particular size. This pad holds the pills directly above a plurality of cutting blades; as the top cover which includes a second solid resilient pad is closed, the pills are pushed against a blade and are split. This advantageously enables a large number of pills to be simultaneously cut in half. As shown in this prior art patent, approximately 30 pills of an oblong shape can be cut. A disadvantage of this design is that to provide different sizes, different pads have to be provided with different hole sizes. Therefore, the device is limited to one particular size pill. As further illustrated, the resilient pad on the top cover must press down on the pill in such a fashion that each pill is cut, in order to accomplish this in such a large base the pressure has to be uniformly applied such that one does not push on one side or the other of the container or top lid in such a fashion that the load is not uniform and therefore pills at one end of the device are not cut through.

Accordingly, while this device achieves the goal of cutting simultaneously as many as 30 pills, it does so in such a fashion that it is limited to one particular size per cut and further by the fact that it can only cut the pills in half. This device is further limited by the fact that it requires a rather strong uniform pressure to achieve a desired breaking of all the pills.

In still another embodiment described in US publication 2009/0031872 an automatic pill cutter is illustrated wherein large supplies of pills can be cut automatically which enables the dispensing of large numbers of pills to be achieved. The drawback of this particular automated device is likely expensive and is ideally suited mainly for a pharmaceutical company as opposed to an individual patient or pharmacy.

To overcome these drawbacks of cutting pills to achieve a reduced dosage for a patient, the present invention provides a means of cutting a large number of pills simultaneously, while also accommodating a variety of different sized pills such that a variety of pill sizes can be cut simultaneously to achieve dosages in a half or even a quarter.

SUMMARY OF THE INVENTION

A multi-tablet cutting device has a removable tablet holding tray, a housing structure and a plurality of vertically movable cutting blades. The removable tablet holding tray has a plurality of tablet nests. Each nest has two or more levels of beds sized to hold tablets of different sizes or shapes. The housing structure has at least one opening to receive the removable tablet holding tray. The plurality of vertically movable cutting blades is mounted on a support structure on the inside of the housing above the tablet holding tray above a location where the tablet holding tray is stored. The plurality of cutting blades is aligned above the tablet nests and upon a downwardly directed vertical movement, the plurality of cutting blades passing through first slots in the nests aligned with the cutting blades. As the blades pass through a geometric center of the nests they cut the tablets held in the nests into halves.

Each nest of the removable tablet holding tray has a second slot extending through the geometric center of the nest perpendicular to the orientation of the first slot. The holding tray can be removed from the housing after a first cut of tablets or otherwise reoriented in the housing by being turned 90 degrees and reinserted or repositioned in the housing. Upon a second downward movement of the plurality of cutting blades the blades will pass through the second slots aligned with the blades, thereby cutting the previously cut tablets a second time dividing the held tablets into quarters. The nests are preferably aligned in rows and the removable tray has a length and width of equal dimensions forming a square tray. Preferably, the nests are oriented in diagonal rows extending 45 degrees relative to the length and width of the tray. It is preferred that the tablet holding tray have at least 9 nests for holding tablets. Preferably, the number of rows equals the number of columns of nests and can be any such combination including large numbers of equal rows and columns. Each nest has at least two levels of beds; the innermost lower level being smaller than an upper level. The upper level of beds provides a round opening centered on the geometric center to hold circular tablets and a pair of oblong portions extending from the round opening to hold oblong shaped tablets at the same upper level. The first slots extend through the geometric center of each nest transversely across the round opening and oblong portions bisecting the nest through both the upper and lower levels. The second slots also extend through the geometric center of the nest transverse to the first slots. Correspondingly, the plurality of blades is oriented diagonally relative to the tray. Accordingly, the housing structure preferably has a blade guide structure with guide slots through which the cutting blades pass and towards the tablet holding tray which is positioned below the guide structure.

A plurality of coil springs is positioned between the support structure and the guide structure wherein the movable blades mounted on the support structure when depressed compress the springs which upon completion of the cut push the blades upwardly to withdraw the blades from the tray and back to their original stowed position.

In a preferred embodiment, the housing structure has an upper portion and a lower portion. The upper portion holds the blades in a separate support structure. A movable chopper handle is attached to the support structure. The lower portion of the housing has a top forming the guide structure with slots for the blades and a bottom base with a pair of tray channels extending from each opening for receiving the tablet holding tray. The tablet holding tray further has a pair of guide rails on the bottom base to slide into the tray channels to align the tray relative to the housing to ensure the slots in the removable tray are aligned with the blades prior to cutting the tablets.

In an alternative embodiment, the housing structure has an upper portion and a lower portion. The upper portion has the support structure being formed as an integral part of the upper portion and the lower portion has one tablet holding tray opening wherein the upper portion moves relative to lower portion to move the blades to cut the tablets held in the tablet holding tray. In this embodiment a plurality of springs is positioned between the upper portion and lower portion of the housing that is compressed during the movement of the upper portion relative to the lower portion to cut the tablets. The upper portion has a guide channel between the support structure and exterior sides of the upper portion. The lower portion has projecting sides which extend into the guide channels to guide and locate the upper portion relative to the lower portion to ensure that the blades are aligned with the slots in the cutting tray. In this embodiment, the lower portion has a hole on a side opposite the opening for receiving the tablet holder tray. The hole is positioned to enable pulling the tablet tray out of the lower portion of the housing structure so that the tray can be reoriented 90 degrees to enable the tablets to be cut a second time into quarters if so desired.

BRIEF DESCRIPTION OF THE DRAWINGS

The invention will be described by way of example and with reference to the accompanying drawings in which:

FIG. 7A shows the combination of different sized pills in the removable holding tray with the blades directly above the pills as illustrated.

FIG. 7B shows the pills with the blades cutting through the various pills as illustrated.

FIG. 7C shows the pills after being cut into halves.

FIG. 7D shows the pills being reoriented 90 degrees relative to those in FIG. 7C wherein the pills are shown with the blades cutting through a second time.

FIG. 7E shows the blades retracted and the pills cut in quarters.

DETAILED DESCRIPTION OF THE INVENTION

Figure 1:
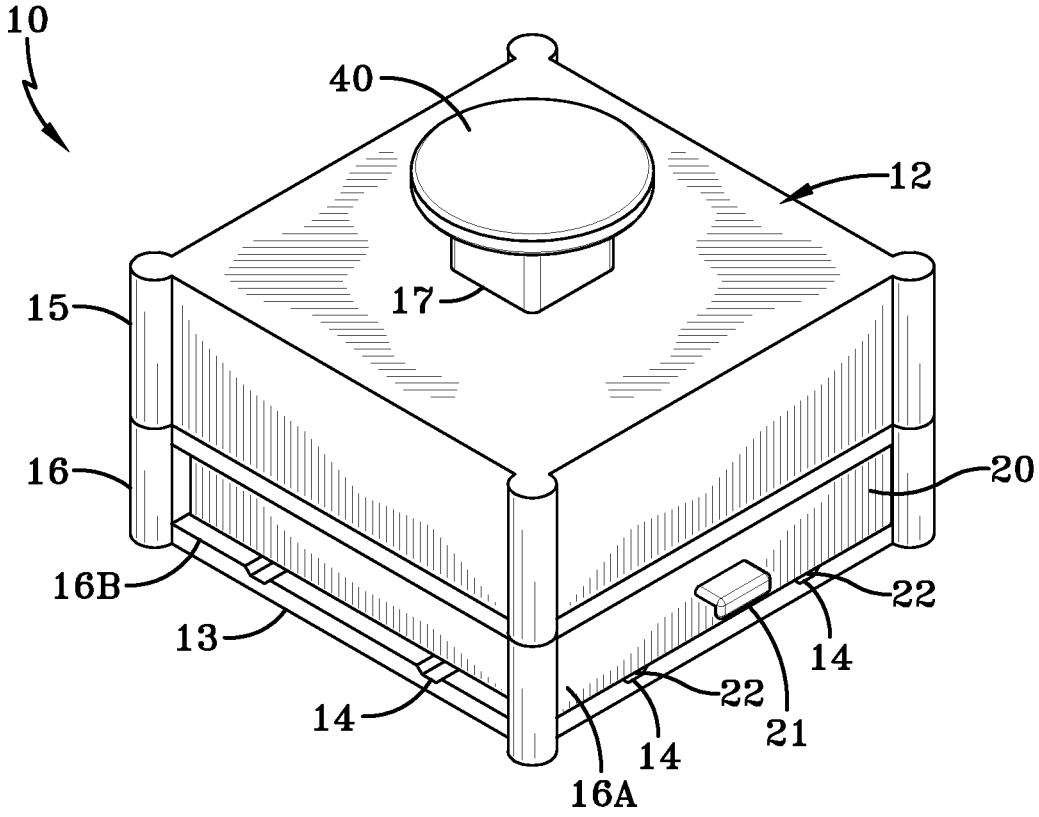
FIG. 1 is a perspective view of the tablet cutting device made according to the present invention.

As illustrated in FIGS. 1-6, a multi-tablet cutting device 10 is made according to the invention. As shown in FIG. 1, the multi-tablet cutting device 10 has a housing structure 12. The housing structure 12 includes an upper portion 15 and a lower portion 16. In the upper portion 15 is an opening 17 through which a chopper handle 40 moves as illustrated. The chopper handle 40 extends above the housing structure 12. In the lower portion 16 of the housing structure 12 there are two openings 16A and 16B, shown in FIG. 2, to accommodate a removable tablet tray 20. The tablet tray 20 as illustrated has a pull out tab 21 projecting from one side of the tray 20. The tray 20 has a pair of lower guide rails 22 which fit into a pair of channels 14 in the base 13 of the lower housing structure portion 16.

Figure 2:
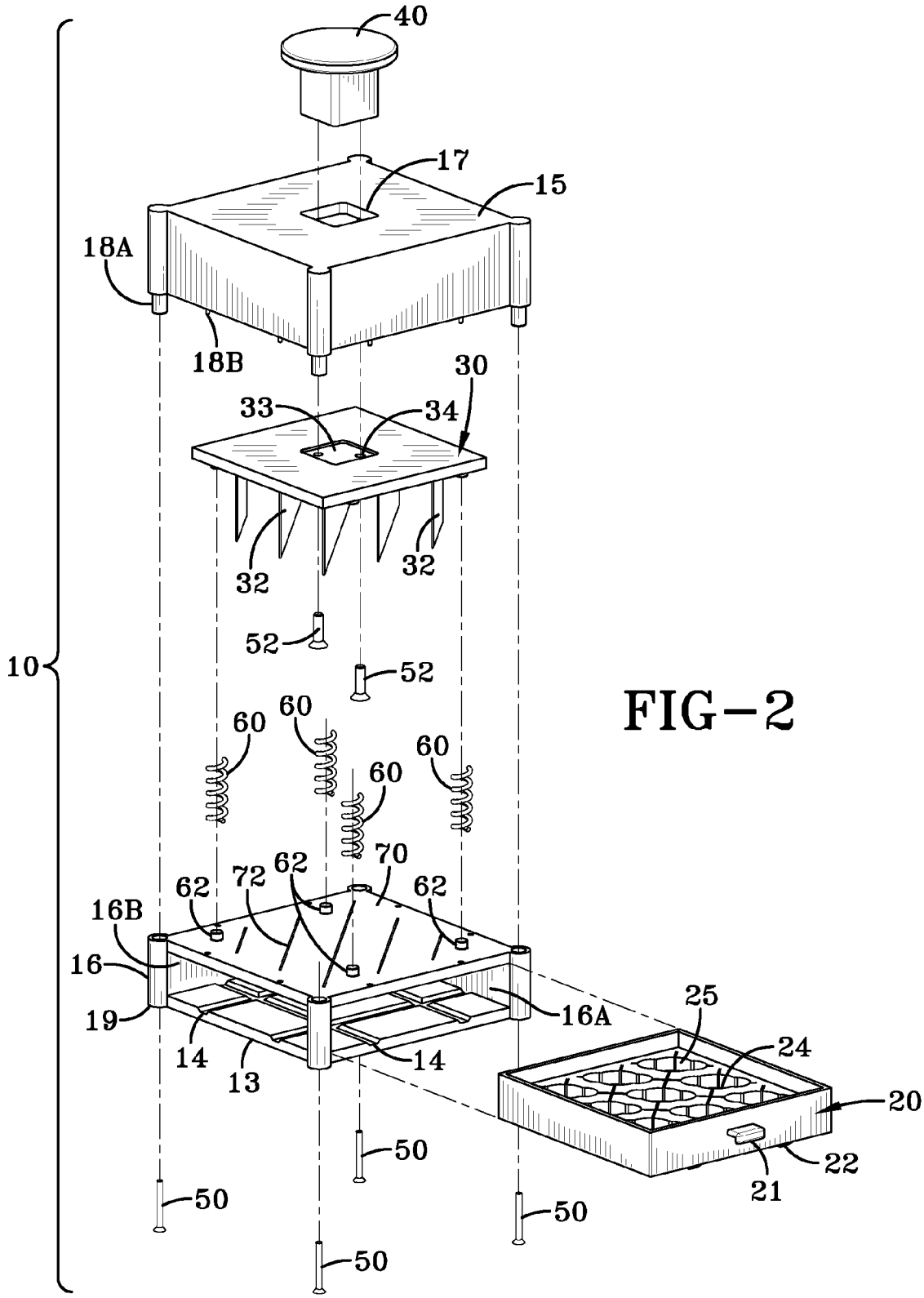
FIG. 2 is an exploded view of the tablet cutting device according to the present invention from a downward looking perspective.
Figure 3:
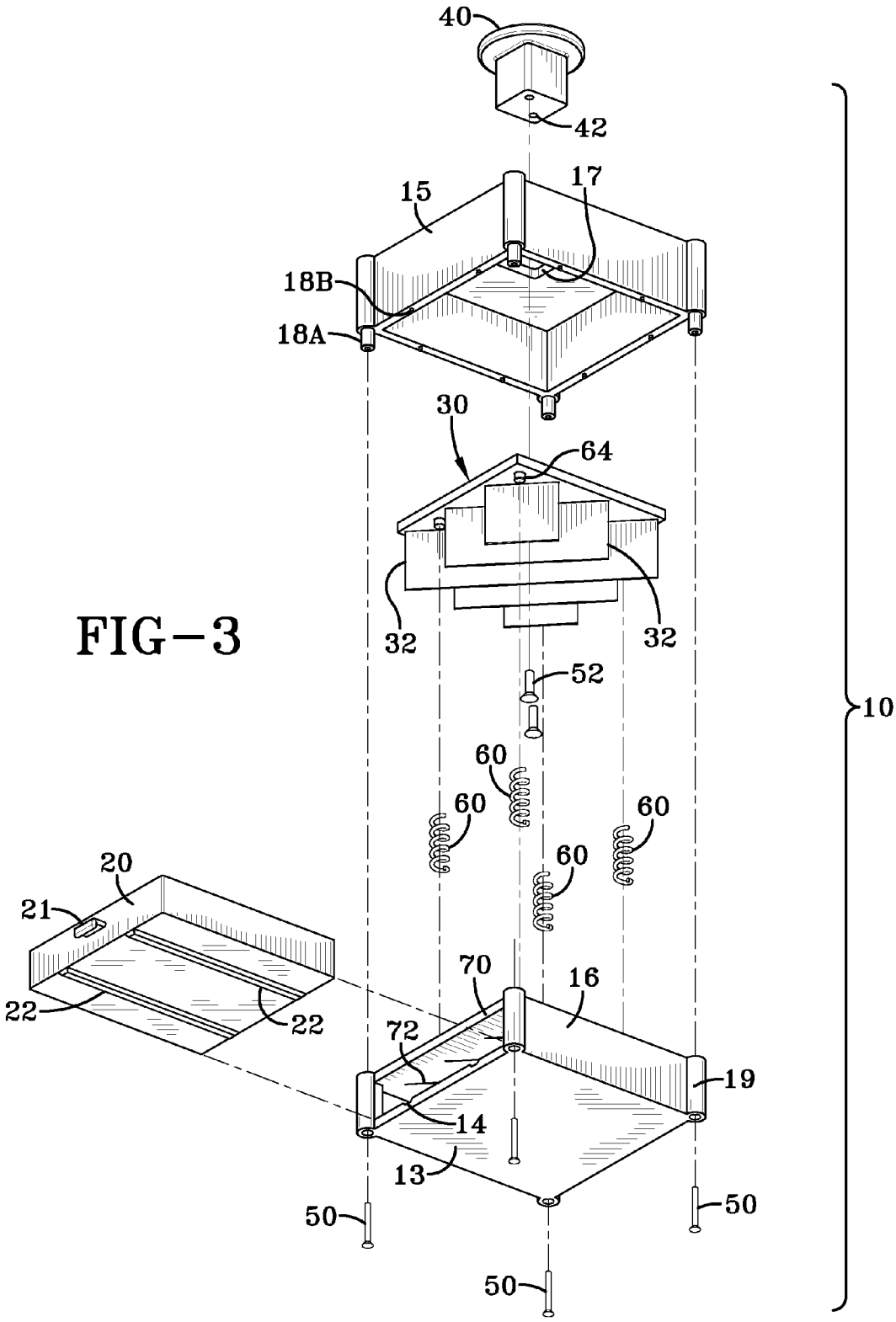
FIG. 3 is an exploded view of the tablet cutting device with an upward looking perspective.

As illustrated in FIGS. 2 and 3, exploded views of the device 10 are shown. In FIG. 2 a slightly downward looking perspective is illustrated, wherein the chopper handle 40 is shown above the upper housing portion 15 exposing the opening 17 through which the chopper handle 40 moves. The upper portion 15, at each corner has protrusions 18A for engaging the upper portion 15 precisely with the lower portion 16. The protrusions 18A preferably have threads such that when the housing structure is assembled, the corners 19 of the lower housing portion mate with the protrusions 18A in the upper housing portion 15 and the threaded fasteners 50 can be screwed together, securing the assembly. Optional additional alignment bumps 18B are shown which can fit into openings shown in the lower portion 16. Interposed between the upper housing portion 15 and the lower housing portion 16 is a support structure 30 upon which a plurality of blades 32 have been secured. The blades 32 project vertically downwardly below the support structure 30. As illustrated, the support structure 30 has a depression 33 and two holes 34 to accept threaded fastener 52. When assembled, the blade structure can be threaded into threaded openings in the chopper handle 40. The threaded openings 42 are as illustrated in FIG. 3. When the threaded fasteners 52 are secured to the chopper handle 40, they provide a way upon which the blades 32 and the support structure 30 holding the blades 32 can be moved vertically upwards and downwards. Directly below the support structure 30 with the plurality of blades 32 are shown four coil springs 60. The coil springs 60 as illustrated in FIG. 2 sit on protrusions 62 and are located therein around the perimeter of the lower support structure 16. This lower support structure 16 has a guide structure 70 formed as an upper surface or top. This guide structure 70 has a plurality of slots 72. These slots 72 are directly aligned with the blades 32 such that they precisely ensure that the blade support structure 30 and the blades 32 are always aligned inside these guide structures when the compression springs push the blades 32 in an upward direction towards the upper surface within the upper portion 15 of the housing. In this stowed position the blades 32 are retracted, but still nested within the slots 72; in this fashion the removable tablet holding tray 20 can be slid in or out of the openings 16A and 16B in the lower portion 16 as illustrated. With further reference to FIG. 3, the underside of the removable tray 20 is exposed to view as the tray 20 is shown withdrawn from the lower portion 16 of the support structure. On the bottom side of the tray 20 is shown guide rails 22. These guide rails 22 fit into the channels 14 of the base 13 of the lower structure 16. As further illustrated, the guide structure 70 on the lower housing 16 includes a plurality of slots 72 which upon assembly, align the blades 32. Interposed between the lower housing portion 16 and the support structure 30 are four coil springs 60. These coil springs 60 fit onto projections 62 in the lower base 16 illustrated in FIG. 2 and onto projections 64 on the support structure 30 holding the blades 32 as can be seen in FIG. 3. These projections 62, 64 secure the opposite ends of the coil springs 60 so that they can provide movement of the blades 32 vertically upwardly to a stowed position. In the downward movement, these springs 60 compress allowing the blades 32 to extend through the slots 72 towards the tablets nested in the holding tray 20. Upon release of the chopper handle 40 the coil springs 60 push the support structure 30 and blades 32 upwardly into the upper housing 15 wherein the blades 32 are located above the area holding the tablet tray 20.

Figure 4A:
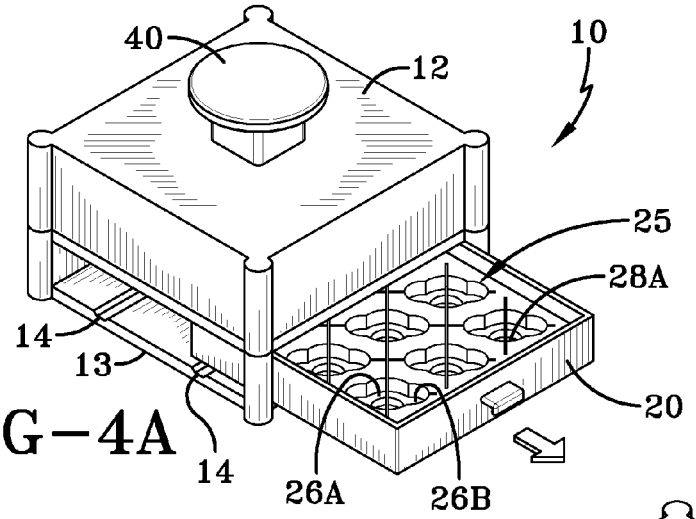
FIG. 4A is a perspective view of the tablet cutting device showing the pill holding tray being withdrawn from a first tray holding opening.
Figure 4B:
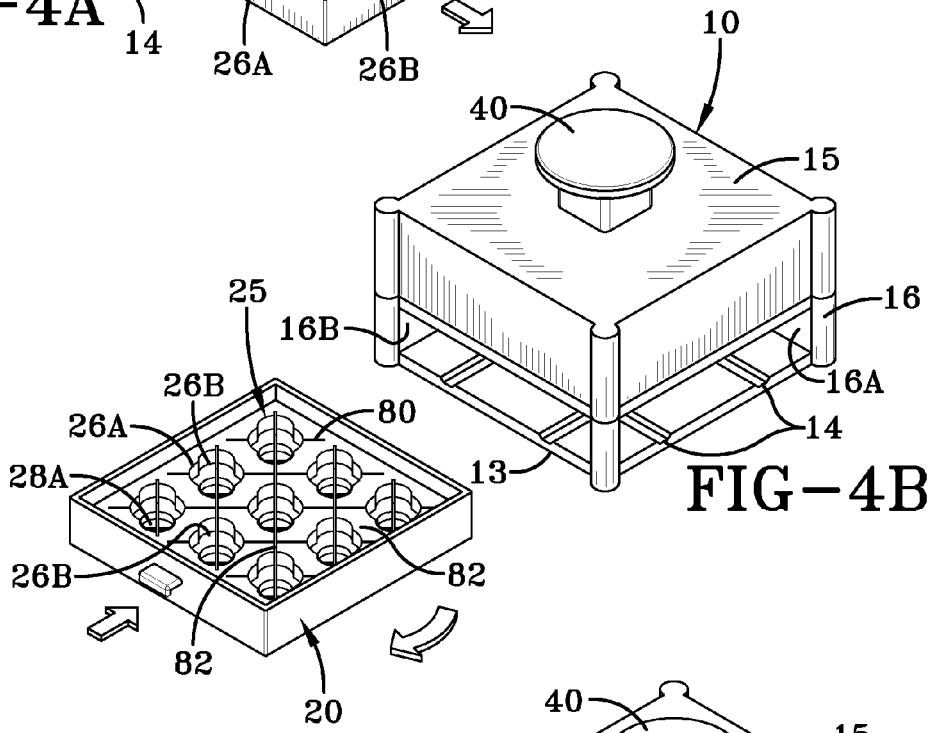
FIG. 4B is a perspective view of the pill holding tray being slid into a second tray holding opening 90 degrees relative to the first opening shown in FIG. 4A.
Figure 4C:
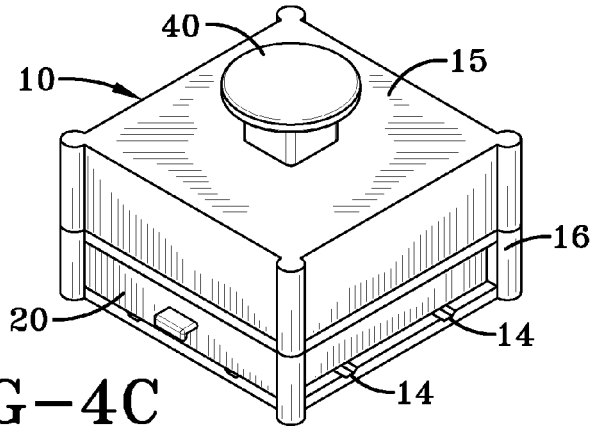
FIG. 4C shows the pill holding tray inserted into the tablet cutting device in a perspective view.
Figure 5:
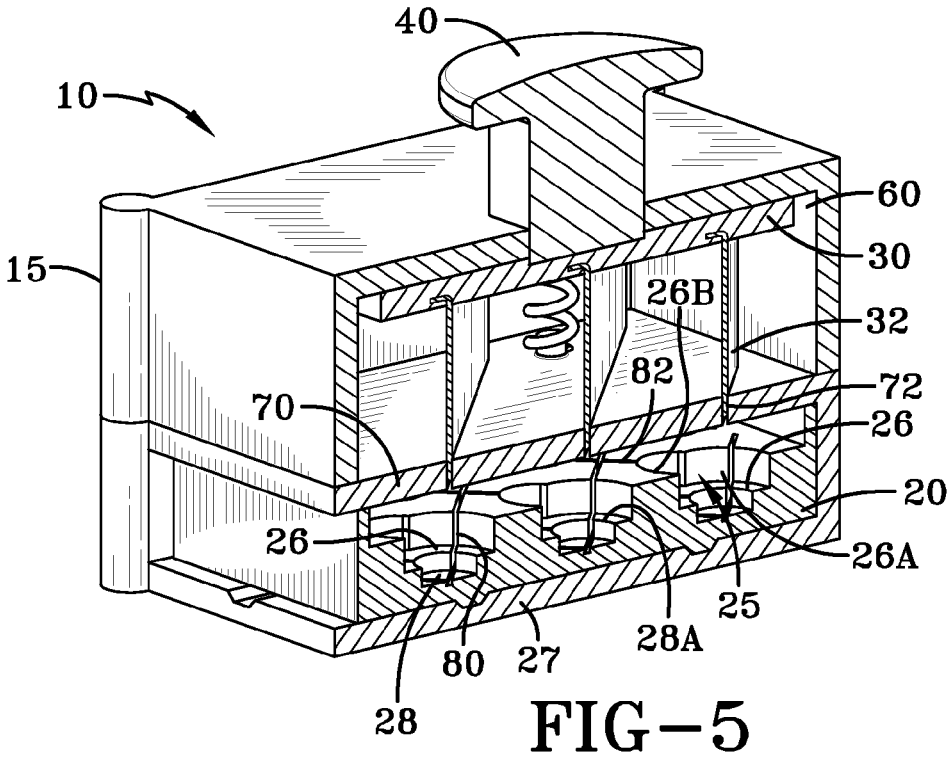
FIG. 5 is a cross sectional view of the tablet cutting device with a spring loaded cutting plunger shown in the upward stowed position.
Figure 6:
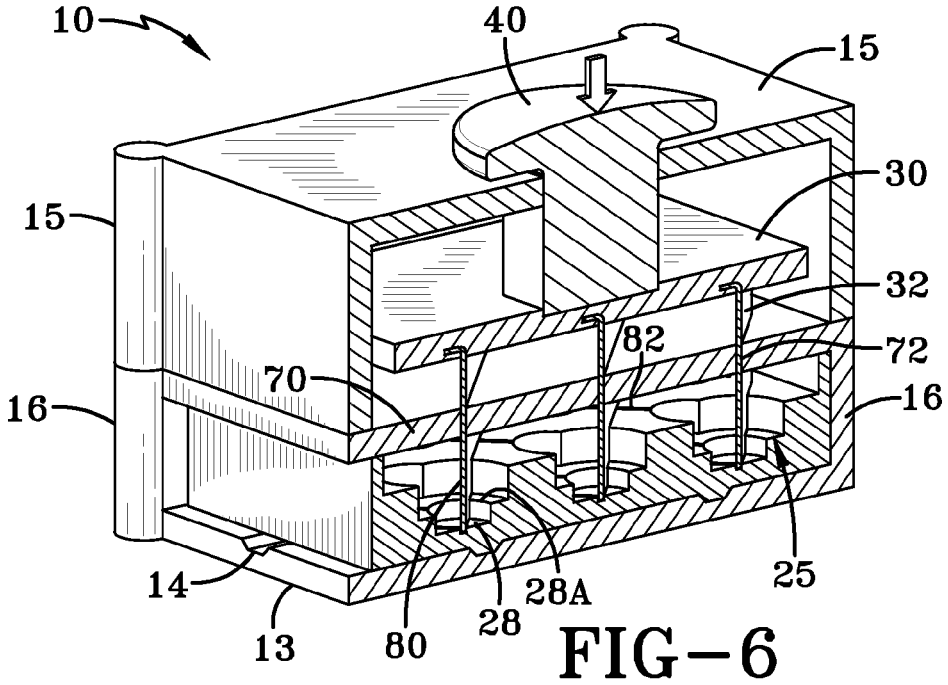
FIG. 6 is a perspective cross sectional view of the device with the cutting plunger shown in the depressed cutting position with the cutting blades shown fully extended into the tablet cutting position.

With reference to FIGS. 4A, 4B and 4C the multi-tablet cutting device 10 is shown wherein the tray 20 is shown in FIG. 4A as being partially withdrawn from the housing 12. In FIG. 4B the tray 20 has been shown removed from its original position in FIG. 4A and reoriented 90 degrees and then pushed into the lower opening 16B as illustrated in FIG. 4C. By having two openings 16A and 16B it is possible to take the tray 20 and to reorient it from one opening to the other. The benefit of this will be disclosed as follows. With reference to FIG. 5, a cross sectional view of the device 10 is illustrated; in this view the handle 40 is shown in a fully extended upright stowed position. The coil springs 60 push the support structure 30 upwardly inside the upper housing portion 15. The blades 32 have a length sufficient so that in the fully extended and upward direction the blades 32 are still located and aligned with the guide slots 72 this ensures that the blades are precisely aligned through these guides 72 and their vertical movement upward or downward is always guided by the guide slots 72. Directly below the guide slots 72 is shown the tray 20. Inside the tray is a plurality of tablet holding nests 25. These nests 25 have two or more beds or levels 26 and 28 as illustrated. The upper level 26, as shown in FIG. 4B and FIGS. 5 and 6, has a large circular portion 26A for accepting round tablets or pills and on each side of the round circular 26A portion extends a pair of oblong portions 26B to accept oblong shaped tablets at level 26. The circular portion 26A and the pair of oblong portions 26B enable different shaped tablets to be accepted at this level. Directly below this upper bed level 26 is a smaller opening 28A at lower bed level 28 designed to accept a round tablet of a smaller size. The tray 20 further includes a solid base 27 such that the tablets are held in a secure fashion in a closed hole environment. As shown in FIG. 4B, in addition to the nest 25 and the plurality of levels for accommodating different-sized, pills are shown slots 80 which extend through the nest's 25 geometric center. A first row of these slots 80 extend diagonally across the tray 20 through the geometric center of each nest 25 within a given row. These slots 80 are precisely positioned and oriented such that they align with the guide slots 72 and the blades 32 when the tray 20 is pushed into the housing structure 15, 16. These guide slots 80 as illustrated in FIG. 5 extend all the way through to the lower level ensuring that the opening 28A for cutting small tablets has a slot 80 extending across it such that the blades 32 can be pushed all the way through the upper bed level 26 through the lower bed level 28 thereby intersecting the whole opening 28A to ensure that the tablets at any level can be cut with a blade 32 as the plunger 40 is being pushed in the downward position, which is illustrated in FIG. 6 wherein the plunger 40 has been pushed into the cutting position showing the blades 32 extending all the way to the lowest level of the tray 20.

A second set of slots 82 is shown also intersecting the geometric center of the tablet nests 25. As shown, these slots 82 are perpendicular to the slots 80 and extend through rows of the nests as illustrated. When the tray 20 is moved into the second cutting position 16B the second row of slots 82 also precisely align with the blades 32 during this 90 degree rotation of the tray 20 and when installed into the housing 16 ensures that the blades 32 will move directly into these slots 82 in such a fashion as to enable the cutting device to cut tablets into quarters.

Figure 7A:
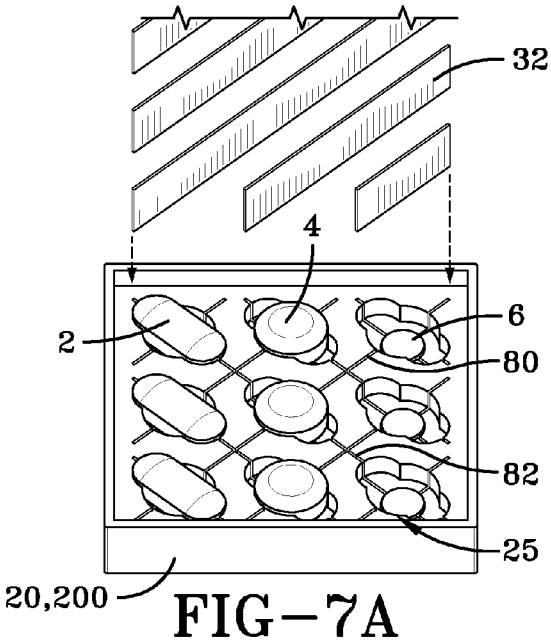
FIG. 7A-7E illustrate various combinations of pills or tablets of different sizes inserted into the pill holding tray.
Figure 7B:
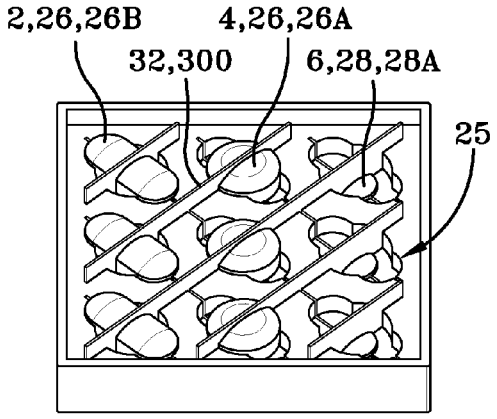
Figure 7C:
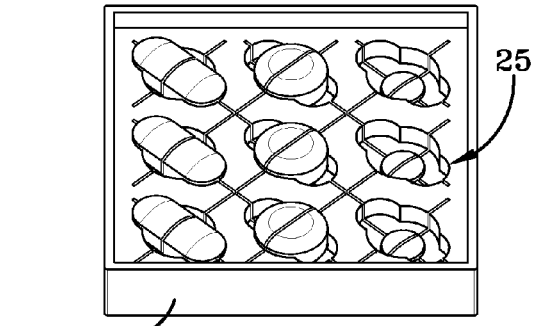
Figure 7D:
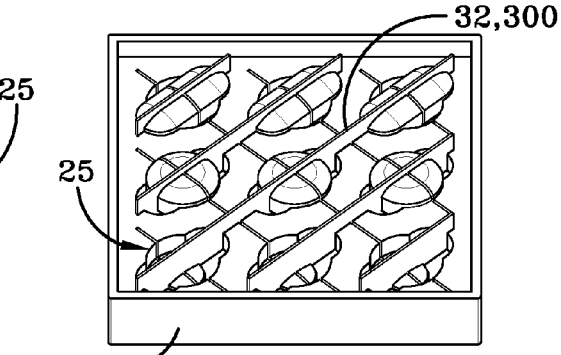
Figure 7E:
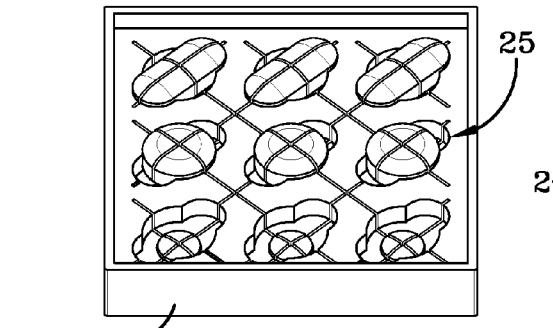
Figure 7F:
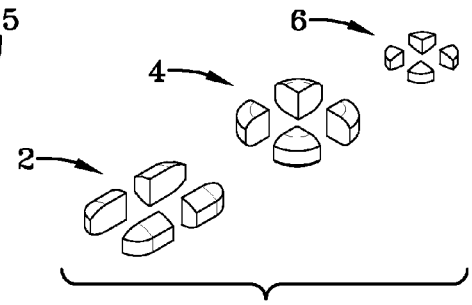
FIG. 7F shows the quartered pills.
Figure 8:
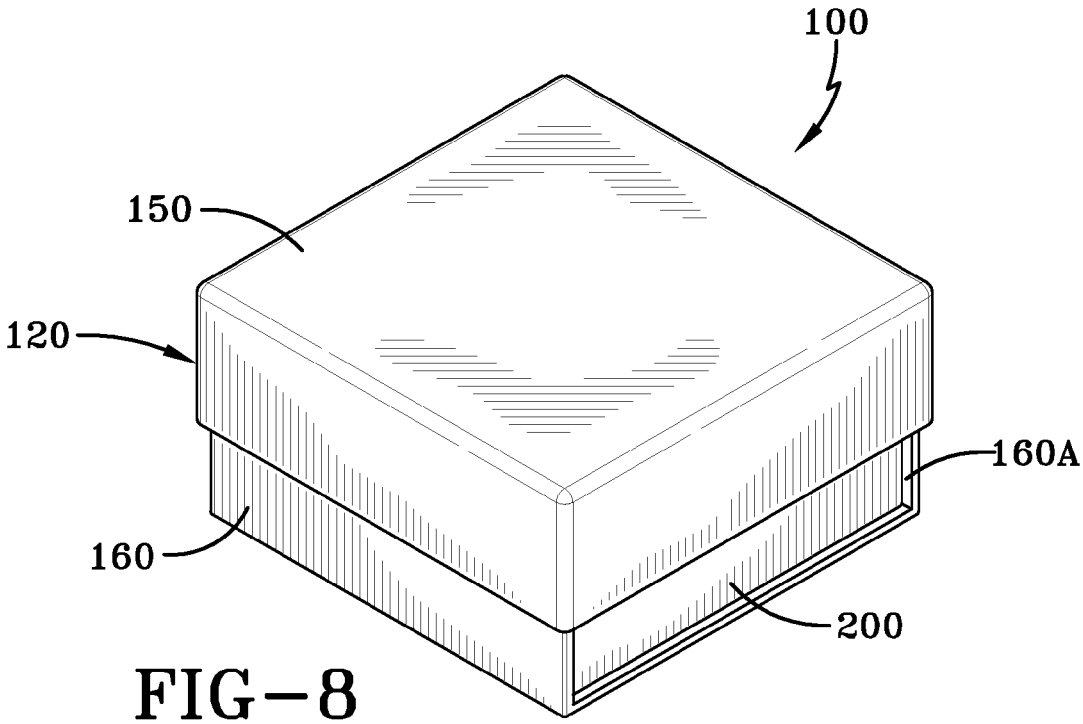
FIG. 8 is a perspective view of an alternative embodiment of the tablet cutter made according to the present invention.

With reference to FIGS. 7A-7F, the holding tray 20 is illustrated where a plurality of tablets is shown mounted into the nests 25. The large oblong tablets 2 are shown in one row; next to those are large circular tablets 4 shown in a next row of nests 25 and small tablets 6 are shown at the lower level 28 in the opening 28A. When loaded into the tray 20 as illustrated the plurality of tablets of different sizes and shapes can be accommodated as shown in FIG. 7A. Directly above the tablets 2, 4, 6 are the plurality of blades 32. As shown, the tray 20 has a length and a width that is substantially equal and the nests 25 are shown diagonally with the slots 80, 82 extending diagonally across the nests at an angle of approximately 45 degrees relative to the sides of the tray 20. In FIG. 7B the blades 32 are shown in a cutting mode wherein the blades 32 have bisected each of the tablets due to a compression of the chopper handle 40 similar to that as shown in FIG. 6; when this occurs tablets can be cut into halves. FIG. 7C shows the blades 32 withdrawn with the tablets shown in their oriented nest bed 25 cut into halves. Then in FIG. 7D the tray has been removed and put into the second opening 16B. With the blades 32 compressed again, as noticed, the oblong tablets 2 are cut along a diagonal. This rotation of the tray 20 of 90 degrees permits the tablets to be aligned with the blades 32 such that the second cut is made 90 degrees relative to the first cut, as a result the tablets are now shown in FIG. 7E where the cut lines show that each tablet has been quartered. When the tablets 2, 4, 6 are removed the quartered pieces are shown as in FIG. 7F. As shown, the cutting device 10 permits the tablets 2, 4, 6 of different sizes and a plurality of said tablets to be cut simultaneously not only into halves but into quarters if so desired.

Figure 9:
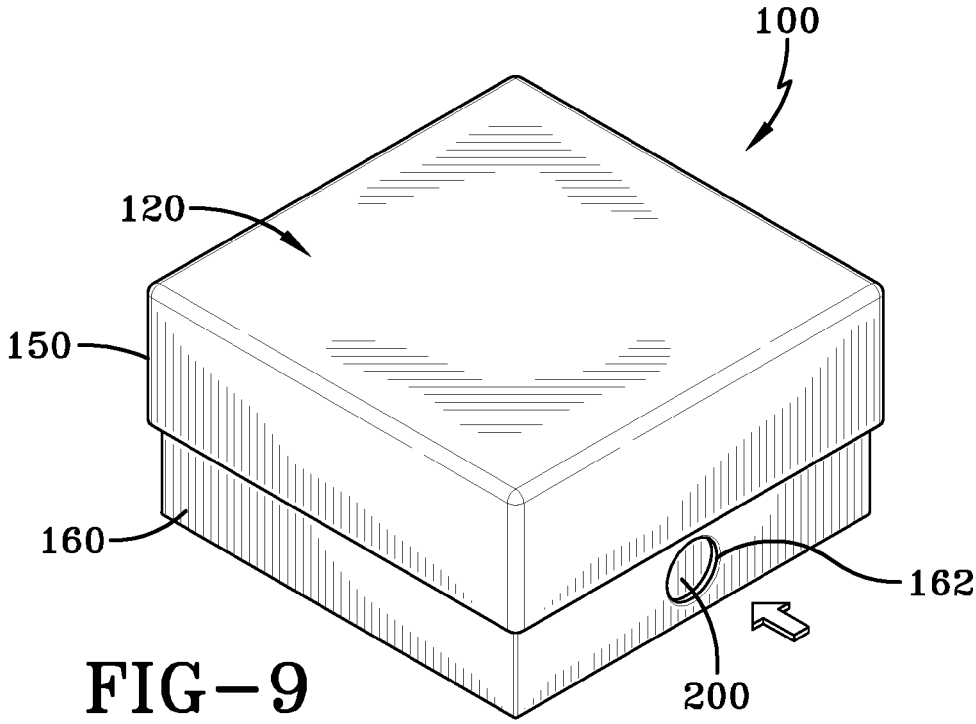
FIG. 9 is an opposite perspective view of the embodiment shown in FIG. 8 showing a hole to push on the pill holding tray.
Figure 10:
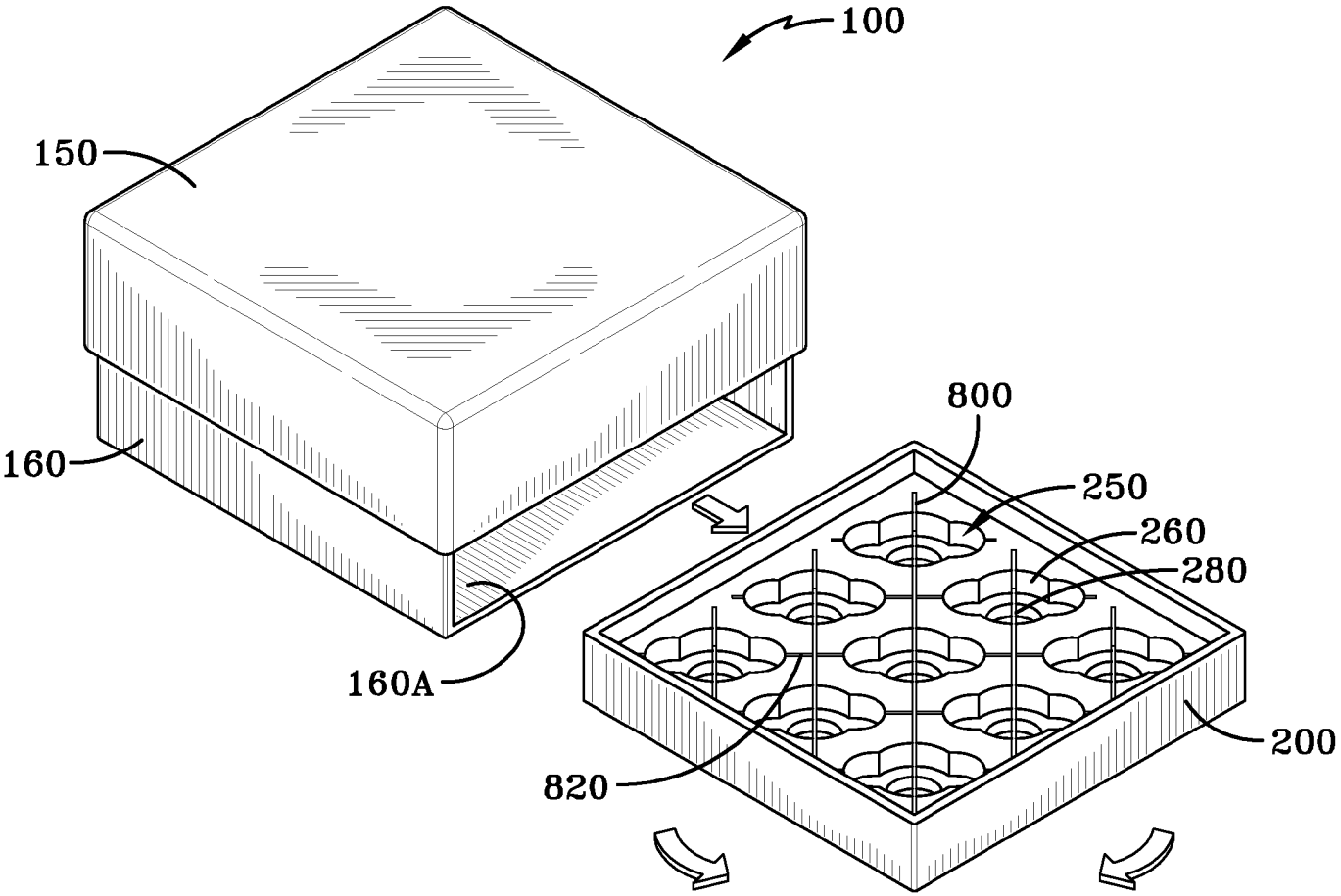
FIG. 10 is a perspective view showing the pill holding tray removed from the tablet cutting device of the alternative embodiment, illustrating how the tray can be reoriented by 90 degrees.

With reference to FIGS. 8-12 a similar but slightly different multi-tablet cutting device 100 is illustrated. This cutting device 100 has a housing structure 120 which includes an upper portion 150 and a lower portion 160 having a single opening 160A into which a removable tablet holding tray 200 is illustrated. In FIG. 9, on a side opposite the opening 160A is illustrated a hole 162 in the side of the lower portion 160. This hole 162 enables the tray 200 to be pushed on a back side thereby enabling the tray to be removed from the device 100 and reoriented. As shown in FIG. 10, when the device 100 has the tray 200 removed, the arrows show directionally that the tray 200 will be rotated 90 degrees similar to that previously described such that any tablets held in the tablet holding tray 200 can be reoriented so that the slots passing through the geometric center of the nests 250 can align with the cutting blades 320. As shown, in the exploded perspective view of FIG. 12, the tray 200 is shown removed from the lower housing 160 and coil springs 600 are shown interposed between the upper housing portion 150 and the lower housing portion 160. As shown, the top of the lower portion 160 includes a guide structure 700 to which a plurality of slots 720 oriented on a diagonal relative to the substantially square shape of the lower housing portion 160. These guide slots 720 align directly with the blades 320 upon assembly and as such in the fully extended position the upper part of the housing structure 150 can fit over the lower portion 160 as illustrated.

Figure 11A:
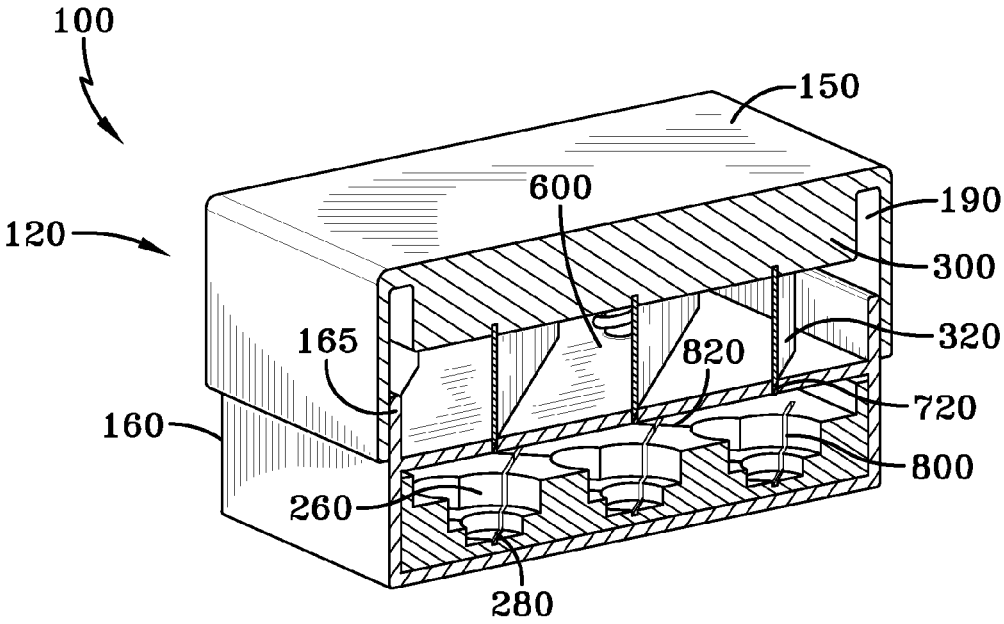
FIG. 11A is a cross sectional perspective of the device made according to the alternative embodiment wherein the pill cutter is shown in the upright stowed non-depressed condition.
Figure 11B:
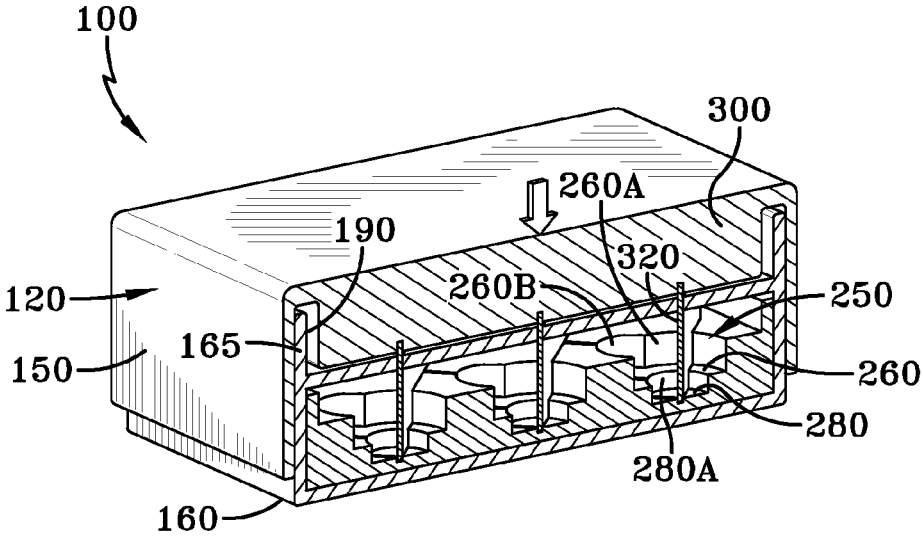
FIG. 11B is a perspective view wherein the top is depressed into the cutting position where the blades are shown in the fully extended position through the slots to the bottom of the nests.
Figure 12:
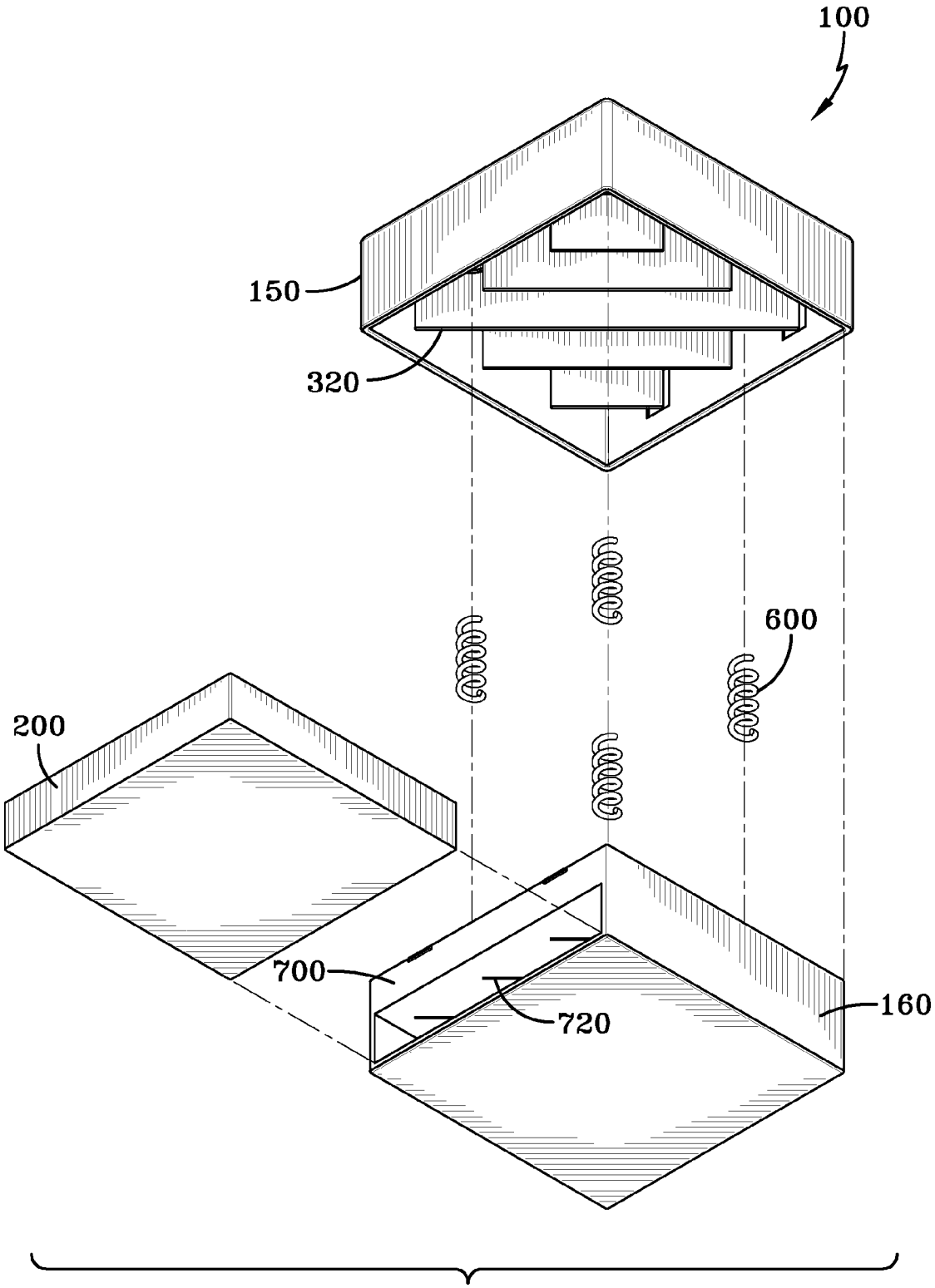
FIG. 12 is an exploded perspective view of the alternative tablet cutting device invention of FIG. 8.

With reference to FIG. 11A, the device 100 is shown where the upper portion of the housing 150 is in the unloaded stowed position wherein the coil springs 600 are fully extended in the upper portion of the housing as illustrated. In this embodiment, the upper portion of the housing 150 has a guide support structure 300 made as an integral portion to the upper portion 150 of the housing structure 120. In this fashion the blades 320 are mounted directly into the support structure 300 in such a fashion that they align with the slots 720 on the lower portion 160 of the housing. Around the outer periphery of the support structure 300 is shown a channel 190. The channel 190 provides a guide for the lower portion 160 to pass. Around the peripheral edge of the lower portion 160 are protruding sides 165, which upon compression of the springs 600 extend into the channels 190 as illustrated in FIG. 11B. Therefore, the entire tablet-cutting device 100 is essentially made with two moving components, an upper housing portion 150 and a lower housing portion 160, wherein compressing the upper housing portion 150 as shown in FIG. 11B enables the coil springs 600 to be compressed wherein the blades 320 can move downwardly into the tablet cutting nests 250. Tablet-cutting nests 250 include beds of an upper portion or level 260 and a lower portion or level 280. As discussed above, the upper portion 260 has a large circular portion 260A for accepting round tablets and a pair of oblong portions 260B to accept oblong tablets at the upper level 260 of the bed and, at the lower level of the bed 280 is a round opening 280A for accepting small circular tablets. Essentially all of the features provided in this alternative embodiment device 100 are identical to those described in the first embodiment of the device 10 as illustrated in the earlier figures. Similarly, the cutting of tablets 2, 4, 6 as illustrated in FIGS. 7A-7F is identical to those for the alternative device 100 and as such the tablets can be cut into either halves or quarters as previously discussed.

As previously discussed, both of these devices 10 and 100 enable multiple tablets of different sizes and shapes to be cut simultaneously into halves. Then, after cutting the tablets into halves, a removable tray 20, 200 holding the tablets can be reoriented 90 degrees either in second opening 16B as illustrated in the figures of the device 10 or in a single opening by simply reorienting the tray 200 as shown in device 100 such that the tablets previously cut in halves can then be cut a second time to form quarters. As illustrated, the device provides a simple method in which a patient or pharmacist can simply place the pills of proper size into the nests 25, 250 where they will rest in the beds 26, 260, 28, 280 as illustrated until cut. Upon cutting the tablets into halves the user has the option of using the tablets cut in half or if so needed can reorient the removable tray 20, 200 in such a fashion that the tablets stored in the nests 25, 250 can be cut a second time into quarters. Upon completion of the cutting the tablets can then be packaged or assembled for later use if so desired.

As shown, the devices 10 and 100 provide simple structures for permitting multiple tablets of different sizes to be cut simultaneously into halves or quarters. It is appreciated that variations in the number of nests 25, 250 or tablets that can be held can be achieved and that alterations in the number of bed levels of the nests holding tablets can be provided such that more or different sizes can be accommodated within each nest. These and other variations are considered within the scope of the present invention. It is further understood that while the device 10, 100 employs coil springs 60, 600 any other means of retracting and compressing the blades 32, 320 can be employed. The device 10 as shown provides a simple means of providing a chopping action to accomplish the cutting of the tablets. This enables a sufficiently strong blow to be administered to the chopping handle 40 such that the blades 32 can drive through the tablets with great ease. Alternatively as shown in device 100 the entire upper structure 150 can be compressed, again by striking the upper portion 150 such that it compresses directly into the lower portion 160 enabling the tablets to be cut. It is believed that this chopping action capability is superior to simply applying a force to break the tablets in that the dynamic movement of the blades 32, 320 striking the tablets will ensure a swift cutting action. This is unlike any other hinged devices requiring a mechanical advantage. The swiftness and quickness of the blades 32, 320 striking the tablets will fracture the tablets in such a way that they are cleanly cut without any pivoting action as the blades act in a guillotine fashion providing a clean sharp cut. It is critical that the removable tray 20, 200 be precisely aligned so that upon the striking of the chopper handle 40 or the upper housing 150 the blades 32, 320 move precisely within the guide slots 70, 700 provided and that the guide slots 70, 700 are precisely aligned with the guide slots 80, 800, 82, 820 in the geometric center of the nests 25, 250. These features are accomplished in the device 10, 100 as presented.

Figure 13:
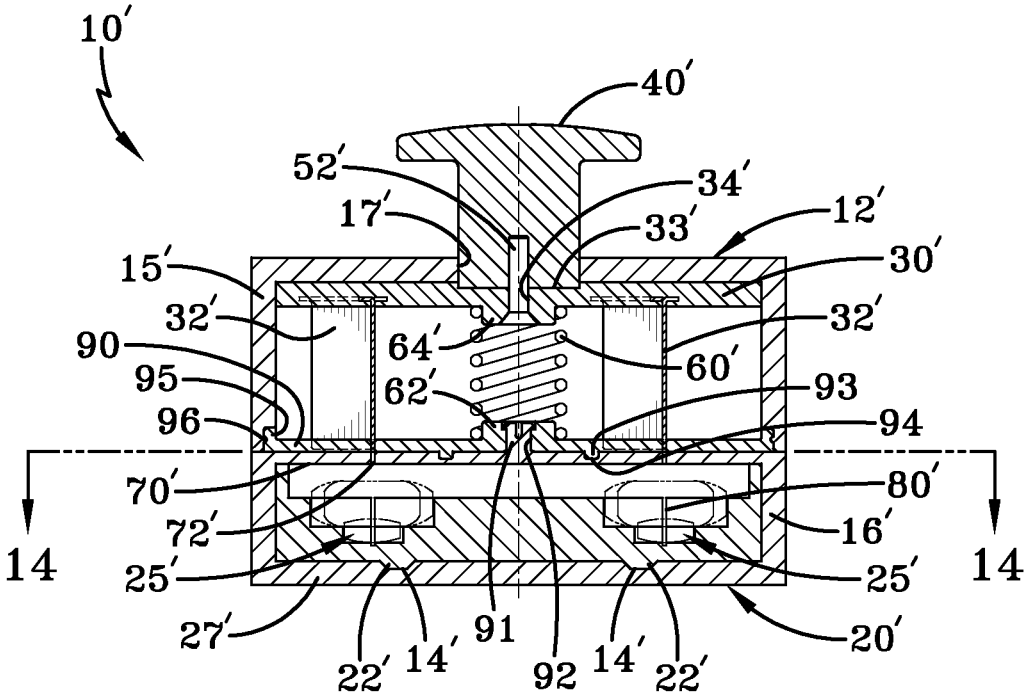
FIG. 13 is a cross sectional view of a third embodiment tablet cutter made according to the invention.

With reference to FIG. 13, a cross sectional view of the third embodiment made according to the present invention, is illustrated. In this embodiment, the housing structure 12' is designed so that the upper housing portion 15' containing the blade support structure 30' and blades 32'. The blade support structure 30' and blades 32' are housed in the upper housing portion 15' and the chopper handle 40' is secured to the support structure 30' and is moveable within the hole 17' using a compression spring 60' to hold the blades 32' in a retracted position except during the process of cutting the pills. As illustrated, the lower housing portion 16' holds the removable tray 20' in such a fashion that the nests 25' are aligned with the blades 32'. Guides 80' and 82' in the lower housing 16' are aligned with openings 70' and 72' in the upper housing 15' such that when the blades 32' are in the retracted position they clear the lower housing 16' completely but are still guided by slots 70', 72' in the upper housing 15'. The lower housing 16' has a central pin 91 that is secured through an opening 92 in such a fashion that the lower housing 16' can pivot or rotate approximately 90 degrees from a first position to a second position. The control of the rotation is provided by guides or grooves 94 into which a pair of stop pins 93 can traverse. These stop pins 93 provide mechanical stops so that when the upper housing 15' is rotated 90 degrees the stop pins 93 stop further rotation and the lower housing 16' will be precisely aligned in the second position such that when a second striking of the chopper handle 40' the blades 32' will move downwardly and cut the pills a second time, cutting the pills into quarters. One blade 32' is provided for each nest 25'; in this embodiment rotation of the upper housing 15' relative to the lower housing 16' enables the tablets to be cut a second time into quarters.

Figure 14:
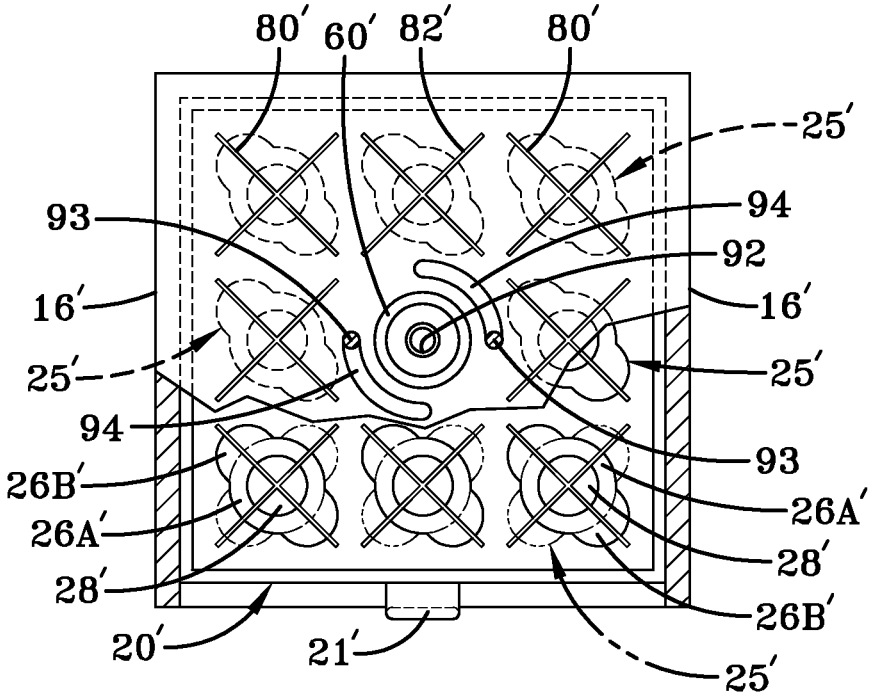
FIG. 14 is a view of the tablet holding tray taken along lines 14-14 of FIG. 13, wherein the solid lines show the first cut position and the dashed lines show the second cut position.

As shown in FIG. 14, the removable tray 20' is shown wherein the nests 25' have the slots 80' reflecting the slots used in the first cutting position as illustrated in FIG. 13. The slots 82' represent the slots for a second cutting position wherein the lower housing portion 16' is rotated 90 degrees, so that the slots 82' shown in dashed lines align with the blades 32' in this rotated position. As illustrated in both FIGS. 13 and 14, all the reference numerals are indicated with a prime next to the number indicating that they are substantially the same elements or features found in the first embodiment of the invention with the addition of the pivotal mechanism reflected in the center of the two housing portions 15' and 16'. In all other regards, the device of this third embodiment operates in exactly the same way as the device in the first embodiment with the exception that the tray 20' itself does not have to be removed from the housing 12' during the procedure where the tablets are to be cut into quarters. This provides a somewhat simpler way of reorienting the tablet tray 20' to permit a second cut. As illustrated, when the tablets are cut either in halves or in quarters, the tray 20' may be removed from the opening in the lower housing portion 16' and the tray 20' can be refilled with tablets so that the procedure can be repeated cutting more tablets either into halves or quarters.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. A multi-tablet cutting device comprises;

a removable tablet holding tray, the tablet holding tray having a plurality of tablet nests, each nest having two or more levels of beds sized to hold tablets of different sizes or shapes;

a housing structure having at least one opening to receive the removable tablet holding tray; and a plurality of vertically movable cutting blades mounted on a support structure on an inside of the housing above the tablet holding tray, wherein the plurality of cutting blades are aligned above the tablet nests and upon a downwardly directed vertical movement the plurality of blades pass through first slots in the nests aligned with the cutting blades passing through a geometric center of the nests cutting the tablets held in the nest in halves and wherein nests at the upper level of beds provide a round opening in the geometric center to hold large circular tablets and a pair of oblong portions extending from the round opening to hold oblong-shaped tablets at the same upper level and wherein the first slots extend through the geometric centers of the net, transversely across the oblong portions bisecting the nest.

2. The multi-tablet cutting device of claim 1 wherein each nest has a second slot extending through the geometric center of the nest perpendicular to the first slot and wherein after a first cut, the holding tray can be removed from the housing or rotated with the housing, turned 90 degrees to reposition in the housing and upon a second downwardly directed movement of the plurality of cutting blades, the cutting blades pass through the second slots aligned with the cutting blades cutting the previously cut tablets a second time, thereby dividing the held tablets into quarters.

3. The multi-tablet cutting device of claim 2 wherein the nests are aligned in rows.

4. The multi-tablet cutting device of claim 3 wherein the removable tray has a length and a width equal in dimension forming a square tray.

5. The multi-tablet cutting device of claim 1 wherein each nest has the two or more levels of beds wherein an innermost lower level is smaller than the upper level.

6. The multi-tablet cutting device of claim 1 wherein the plurality of blades are oriented diagonally relative to the tray.

7. The multi-tablet cutting device of claim 1 wherein the housing structure has a guide structure with guide slots through which the cutting blades pass through the guide slots.

8. The multi-tablet cutting device of claim 1 further comprises a plurality of coil springs positioned between the support structure and the guide structure wherein the movable blades mounted on the support structure when depressed compress the springs which upon completion push the blades upwardly to withdraw the blades.

9. The multi-tablet cutting device of claim 1 wherein the housing structure comprises:

an upper portion with the support structure being formed as part of the upper portion and a lower portion with a tablet holding tray opening; wherein the upper portion moves relative to the lower portion to move the blades to cut the tablets held in the tablet holding tray.

10. The multi-tablet cutting device of claim 9 further comprises a plurality of springs between the upper portion and the lower portion that are compressed during movement of the upper portion to cut the tablets.

11. The multi-tablet cutting device of claim 9 wherein the upper portion has a channel between the support structure and exterior sides of the upper portion; and wherein the lower portion has projecting sides which extend into the channels to guide and locate the upper portion relative to the lower portion.

12. The multi-tablet cutting device of claim 9 wherein the lower portion has a hole on a side opposite the opening for receiving the tablet holding tray, the hole being for pushing the tablet tray out of the lower portion of the housing structure.

13. A multi-tablet cutting device comprises;

a removable tablet holding tray, the tablet holding tray having a plurality of tablet nests, each nest having two or more levels of beds sized to hold tablets of different sizes or shapes;

a housing structure having at least one opening to receive the removable tablet holding tray;

a plurality of vertically movable cutting blades mounted on a support structure on the inside of the housing above the tablet holding tray, wherein the plurality of cutting blades are aligned above the tablet nests and upon a downwardly directed vertical movement the plurality of blades pass through first slots in the nests aligned with the cutting blades passing through a geometric center of the nests cutting the tablets held in the nest in halves; and wherein each nest has a second slot extending through the geometric center of the nest perpendicular to the first slot and wherein after a first cut, the holding tray can be removed from the housing or rotated with the housing, turned 90 degrees to reposition in the housing and upon a second downwardly directed movement of the plurality of cutting blades, the cutting blades pass through the second slots aligned with the cutting blades cutting the previously cut tablets a second time, thereby dividing the held tablets into quarters and the removable tray has a length and a width equal in dimension forming a square tray and the nests are aligned in rows oriented in diagonal rows extending 45 degrees relative to the length and width of the tray.

14. The multi-tablet cutting device of claim 13 wherein the tray has equal numbers of rows and columns of nests for holding tablets.

15. The multi-tablet cutting device of claim 13 wherein nests at the upper level of beds provide a round opening in the geometric center to hold large circular tablets and a pair of oblong portions extending from the round opening to hold oblong-shaped tablets at the same upper level and wherein the first slots extend through the geometric centers of the nests, transversely across the oblong portions bisecting the nest.

16. The multi-tablet cutting device of claim 13 wherein the plurality of blades are oriented diagonally relative to the tray.

17. A multi-tablet cutting device comprises;

a removable tablet holding tray, the tablet holding tray having a plurality of tablet nests, each nest having two or more levels of beds sized to hold tablets of different sizes or shapes;

a housing structure having at least one opening to receive the removable tablet holding tray;

a plurality of vertically movable cutting blades mounted on a support structure on the inside of the housing above the tablet holding tray, wherein the plurality of cutting blades are aligned above the tablet nests and upon a downwardly directed vertical movement the plurality of blades pass through first slots in the nests aligned with the cutting blades passing through a geometric center of the nests cutting the tablets held in the nest in halves;

a movable chopping handle attached to the support structure; and wherein the housing structure has an upper portion and a lower portion, the upper portion holds the blades mounted on a separate support structure and the lower portion of the housing has a top forming the guide structure and a bottom base with a pair of tray channels extending from each opening for receiving the tablet holding tray; and the tablet holding tray has a pair of guides on the bottom base to slide into the tray channels to align the tray relative to the housing.

* * * * *